US006533022B2

(12) United States Patent
Hunter

(10) Patent No.: US 6,533,022 B2
(45) Date of Patent: Mar. 18, 2003

(54) POURING CONVEYOR FOR MOLD HANDLING SYSTEM

(75) Inventor: William A. Hunter, Naples, FL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 2 days.

(21) Appl. No.: 09/928,205

(22) Filed: Aug. 10, 2001

(65) Prior Publication Data

US 2003/0029597 A1 Feb. 13, 2003

(51) Int. Cl.[7] ..... B22D 33/00

(52) U.S. Cl. ..... 164/324; 164/323; 164/329; 164/193

(58) Field of Search ..... 164/324, 323, 164/329, 193

(56) References Cited

U.S. PATENT DOCUMENTS 3,612,159 A * 10/1971 Galinsky ..... 164/324
5,062,465 A * 11/1991 Mortensen ..... 164/4.1
6,145,577 A * 11/2000 Hunter ..... 164/323
6,263,952 B1 * 7/2001 Hunter ..... 164/324

* cited by examiner

*Primary Examiner*—Tom Dunn
*Assistant Examiner*—I.-H. Lin
(74) *Attorney, Agent, or Firm*—Leydig, Voit & Mayer, Ltd.

(57) ABSTRACT

A conveyor for a molding machine and a molding machine incorporating the conveyor in which the portion of the conveyor and its driven rollers that run through the pouring station have been shortened such that the pallets extend over the conveyor to shield the conveyor and rollers from molten metal, and in which the rollers are slanted at an oblique angle relative to the intended path of the molds such that the driven rollers bias the pallets away from the pouring line to ensure that pallets carrying molds do not fall off the conveyor onto the pouring line.

32 Claims, 7 Drawing Sheets

POURING CONVEYOR FOR MOLD HANDLING SYSTEM

FIELD OF THE INVENTION

The present invention relates generally to conveyors, and more particularly relates to pouring conveyors for mold handling systems.

BACKGROUND OF THE INVENTION

Molded metal castings are commonly manufactured at foundries through a matchplate molding technique. This technique employs green sand molds comprised of prepared sand and additives that are compressed around cope and drag patterns mounted on opposite sides of a matchplate. The sand mold is thus formed in upper and lower matching portions, an upper cope mold, and a lower drag mold. The cope mold is formed in a separate cope flask that is filled with prepared sand and compacted onto the matchplate. The matchplate is the removed leaving an indentation in the cope mold of the desired shape for the upper portion of the casting. Simultaneously, the drag mold is formed in a separate drag flask. Usually the matchplate is in the form of a planar member with the pattern for the cope mold on one side and the pattern for the drag mold on the other. After the cope and drag molds have been formed, they are placed together to form a unitary mold having an interior cavity of the desired shape. The cavity can then be filled with molten metal through an inlet or "sprue" provided in the cope mold to create the desired casting. Such a system is disclosed in Hunter, U.S. Pat. No. 5,022,212, the disclosure of which is hereby incorporated by reference in its entirety.

Once the mold is formed, the mold is then placed into a mold handling system through which various steps are performed to achieve the desired metal castings. After leaving the mold-making machine, the molds are carried on pallets through a weight and jacket installation station. There, supportive weights and jackets are installed on the sand molds to provide support for the heavy molten material that will be received in the internal cavity of the mold. Molds are then conveyed through a pouring station where molten material is poured into the sand molds. The molten material is then conveyed further until sufficient cooling has taken place at which the weights and jackets are removed and recycled to the weight and jacket installation station for reuse. Thereafter, the molten material is cooled even further through an additional cooling station such as a cooling conveyor or a cooling carousel. Once the molten material is sufficiently hard and rigid, the sand molds are broken and the metal castings released. Mold handling systems are generally disclosed in U.S. Patents owned by the present assignee including: U.S. Pat. Nos. 4,589,467, 5,901,774, 5,927,374, 5,971,059, 6,145,577 and 6,263,952, the entire disclosures of which are hereby incorporated by reference in their entirety to illustrate some of the different arrangements for which the present invention may be applicable.

While the foregoing molding machines and their mold handling systems have met with substantial commercial success, they are not without drawbacks. One drawback existing in the art relates to the conveyor mechanism that transports molds on pallets through the pouring station. In particular, after molten metal material is poured into the molds at the pouring station, sometimes drops of molten metal material are inadvertently spilled onto the conveyor and the rollers of the conveyor (including the bearings of the rollers). This is undesirable and can cause operating problems and downtime for the conveyor.

BRIEF SUMMARY OF THE INVENTION

In light of the above, it is a general objective of the present invention to remedy the problems associated with spillage of molten material on the conveyor at the pouring station of a molding machine.

In that regard, it is a further objective to keep the pallets carrying molds on the desired path through a mold handling system.

In accordance with these and other objectives, the present invention is directed toward a conveyor for a molding machine and a molding machine incorporating the conveyor in which the portion of the conveyor and its driven rollers that run through the pouring station have been shortened such that the pallets extend over the conveyor to shield the conveyor and rollers from molten material. In the preferred embodiment, these rollers are also slanted at an oblique angle relative to the intended path of the molds such that the driven rollers bias the pallets away from the pouring line to better ensure that pallets carrying molds do not wander laterally and fall off the conveyor onto the pouring line. Alternative biasing means are also disclosed and may be used.

A molding machine according to the invention comprises a sand mold forming station adapted to form a plurality of sand molds. The molds are carried on pallets through a pouring station downstream of the sand mold forming station. A cooling station is located downstream of the pouring station for cooling the material in the molds to form metal castings. A conveyor transports the molds on the pallets along a linear path through the pouring station. At the pouring station, molten metal is poured into the molds along one side of the conveyor (e.g. a pouring side or "pouring line"). The conveyor has rollers at the pouring station carrying the molds on the pallets. The rollers are driven by a motor to move the pallets and molds along the linear path. The pallets extend horizontally beyond the rollers toward the pouring line to shield and prevent molten material from being spilled onto the rollers. The rollers rotate about rotational axes that intersect the linear path at an oblique angle sufficiently large enough such that when the rollers are driven, the pallets are mobilized forwardly along the linear path with a bias away from the pouring line. This prevents pallets from falling off on the pouring side.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
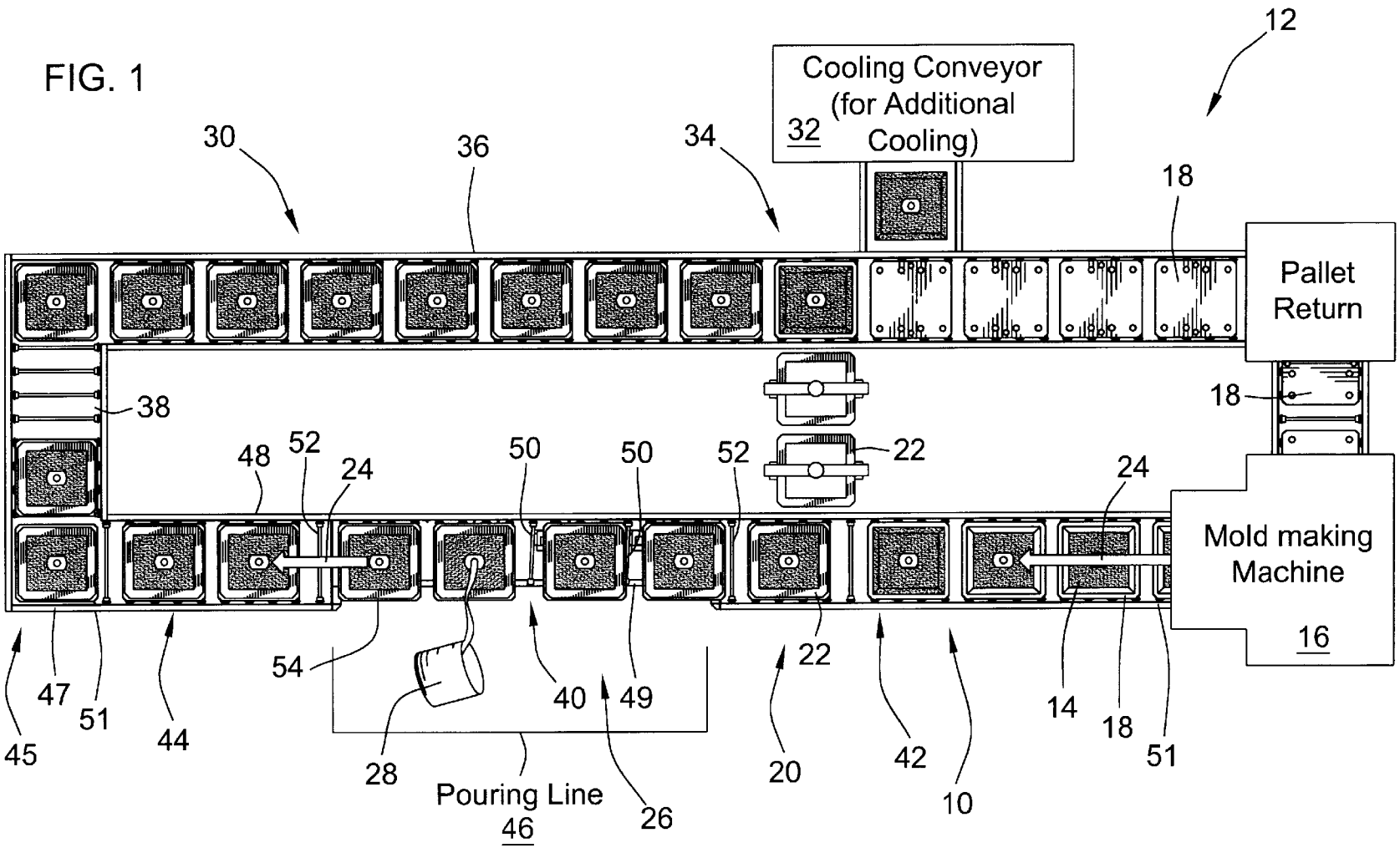
FIG. 1 is a plan view of pouring conveyor incorporated into a molding machine, illustrated in partial schematic form, according to an embodiment of the present invention.

For purposes of illustration and referring to FIG. 1, an embodiment of the present invention has been illustrated as a pouring conveyor 10 incorporated into a molding machine 12. As will be described below, the molding machine 12 includes multiple stations for creating and processing sand molds 14 to produce metal castings.

In the disclosed embodiment, the molding machine 12 includes a sand mold forming station 16 (typically an automatic matchplate molding machine) for forming the cope and drag portions of sand molds 14. Sand molds 14 leaving the forming station 16 are carried on pallets 18 supported on the pouring conveyor 10. After leaving the forming station, the sand molds 14 are conveyed downstream along a predetermined linear path 24 to a weight and jacket station 20 where the molds 14 receive supportive weight and jackets 22. Then, the molds 14 are conveyed downstream through a pouring station 26 where molten material 28 is poured into the sand molds 14. The molds 14 then proceed further downstream and are subjected to two cooling stages at cooling stations 30, 32 that are separated by a weight and jacket removal station 34. During the initial cooling stage at the first cooling station 30, the weights and jackets 22 remain on the molds 14 to ensure structural integrity of the molds 14. Once the molten material in the molds 14 has cooled sufficiently, the weight and jackets 22 are removed at the removal station 34 and the molds may be subjected to further downstream cooling on cooling conveyors, carousels or other cooling systems in the second cooling station 32. The weight and jackets 22 which are removed at the removal station 34 are recycled to the weight and jacket installation station 20.

To provide for easy recycling of weights and jackets 22, the pouring conveyor 10 is arranged in parallel with a linear return conveyor 36 that transports molds in an opposite direction to the linear conveyor 10. A connecting transfer conveyor 38 may be used to convey molds 14 from the pouring conveyor 10 to the return conveyor 36. Further details of the transfer conveyor 38 used in the disclosed embodiment of FIG. 1 are disclosed in Hunter, U.S. Pat. No. 6,263,952, the entire disclosure of which is hereby incorporated by reference.

Referring in greater detail to the primary focus of the preferred embodiment, i.e. the pouring conveyor 10, it can be seen with reference to FIG. 1 that the pouring conveyor 10 includes a narrower, partial width section 40 interposed between two full width sections 42, 44. The upstream full width section 42 receives molds 14 on pallets 18 from the mold forming station 16 and conveys the molds 14 on pallets 18 through the weight and jacket installation station 20. The upstream full width section 42 terminates and merges into the partial width section 40 which is also the beginning of the pouring line 46 of the pouring station 26. Molten material 28 may be poured into the molds 14 anywhere along the pouring line 46. The partial width section 40 terminates and merges into the downstream full width section 44 which also provides for some initial cooling of molten material in the molds and positions the pallets 18 for lateral transfer on the transfer conveyor 38. For purposes of differentiation the term "proximate" may be used to describe the side or end of the conveyor proximate the pouring line while the term "distal" can be used to describe the side or end of the conveyor on the non pouring side away from the pouring line.

The pouring conveyor 10 includes a metal frame support chassis 45 comprised of vertical supports 43 that support horizontal beams 47, 48 in spaced parallel relation. The support beam 47 along the pouring line side of the conveyor 10 is broken up into an inset beam section 49 at the pouring line and full width beam sections 51 along the full width sections 42, 44. The horizontal beams 47, 48 support a first set of rollers 50 in the partial width section 40 and a second set of rollers 52 for the upstream and downstream full width sections 42, 44. One or more motors 53 supported on the conveyor chassis 45 drive the rollers 50, 52 to impart a forward motion to pallets 18 and molds 14 along the predetermined linear path 24.

Figure 2:
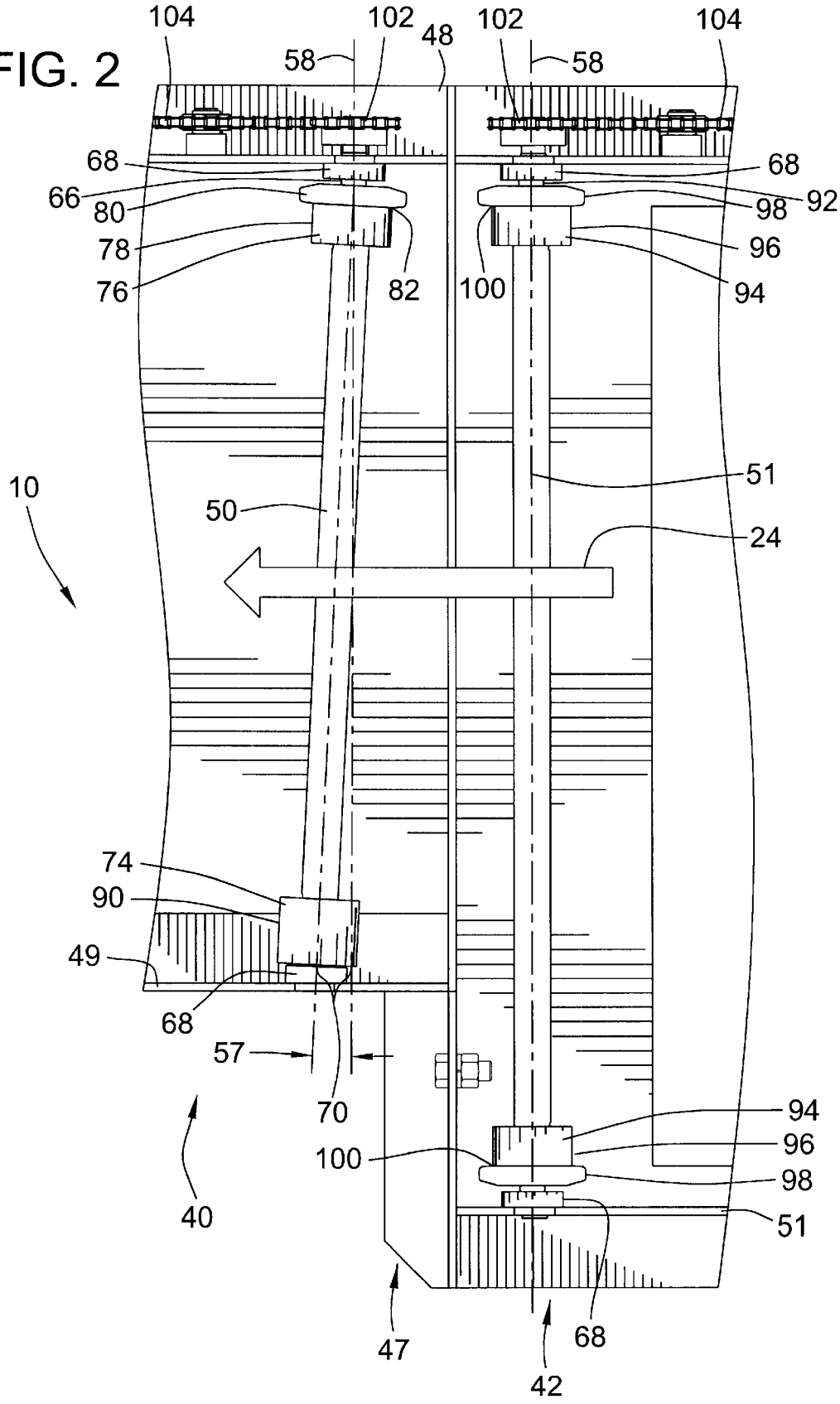
FIG. 2 is enlarged top view of a portion of the pouring conveyor (at the transition between full width and partial width sections) of the embodiment illustrated in FIG. 1.
Figure 3:
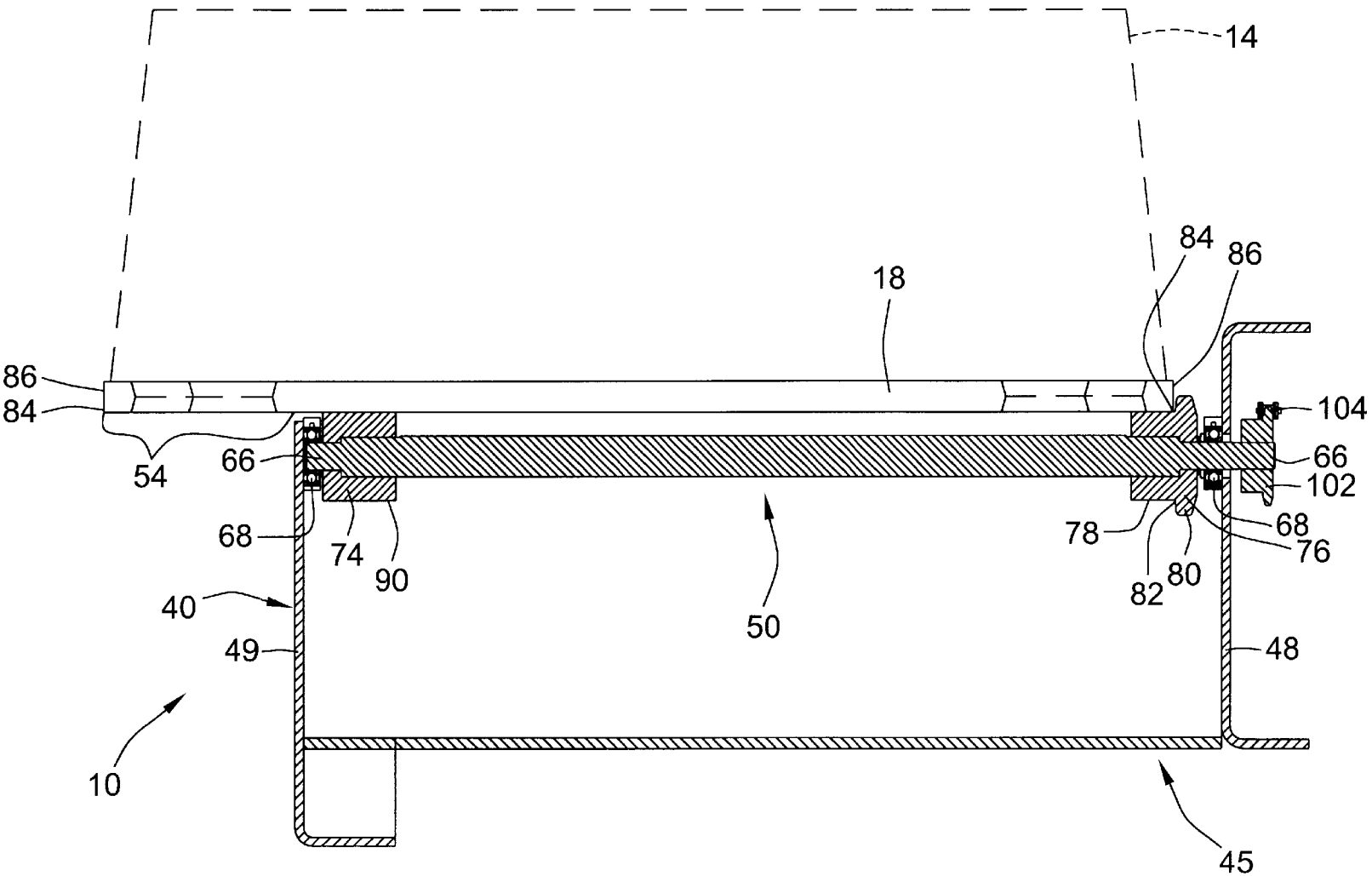
FIG. 3 is a cross section of the shorter roller illustrated in FIG. 2, with a pallet and mold indicated in dashed lines.

When viewing FIGS. 1 and 2, it can be readily seen that there are a couple of differences between the first set of rollers 50 and the second set of rollers 52. One difference is that the first set of rollers 50 are shorter with a support surface that engages the underside of the pallets 18 that is shorter in length than the width of the pallets 18 as seen in FIG. 3 (the pallet width being defined as the pallet length perpendicular to the linear path 24). It is an advantage that the pallets 18 extend horizontally beyond the first set of rollers 50 toward the pouring station 26 to provide a shield and prevent molten material 28 from being inadvertently spilled onto the first set of rollers 50. This also increases pouring clearance along the pouring line 46. The inset beam section 49 and the entire pouring side of the conveyor 10 are also contained under the overhang portion 54 of the pallet 18 to be better protected from molten material.

In contrast the second set of rollers 52 have a support surface with a length not less than the width of the pallets 18. The pallets are also contained between both horizontal support beams 47, 48 along the full width sections 42, 44.

Another difference is that the first set of rollers 50 are aligned at a different angular orientation. In particular, the first set of rollers 50 rotate about a rotational axis 56 that intersects the linear path 46 at an oblique angle 57. The first set of rollers 50 are thus slanted and arranged in such a way to cause the pallets 18 to be biased away from the pouring line 46 when driven. This prevents the pallets 18 from wandering laterally toward the pouring line 46 and prevents the pallets 18 from falling off of the pouring side of the conveyor 10.

In contrast the second set of rollers 52 have a rotational axis 58 that is perpendicular to the linear path 24 of the pallets 18 and molds. When the second set of rollers 52 are driven, the pallets 18 are mobilized generally in an unbiased manner along the predetermined path 24.

Referring to FIG. 3, the structural details of one of the shortened first rollers 50 are illustrated. Each first roller 50 includes a central support shaft 66 (with a central hexagonal segment and turned down cylindrical ends) journalled in spaced apart bearings 68 that are secured to the spaced apart support beams 49, 48. The bearings 68 facilitate rotation of the rollers 50, 52 about the rotational axes 56. For the partial width section 40, the bearings 68 are horizontally offset along the predetermined linear path 24 at a horizontal spacing 70 to orient the rollers 50 at the desired oblique angle 57 to provide a biasing means for biasing pallets away from the pouring line. The individual bearing 68 that is secured to the inset beam section 49 is positioned in front of the other bearing 68 that is secured to the distal horizontal beam 48 to provide the spacing 70. This spacing 70 is sufficient to provide an oblique angle 47 that is sufficiently large enough that when the first rollers 50 are driven, the pallets 18 are mobilized forwardly along the linear path 24 with a bias away from the pouring line 46 to ensure pallets 18 do not wander laterally and fall off onto the pouring line 46. It has been found that spacing 70 substantially equal to or greater than 1/16th of an inch (measured at the rotational center of the bearings 68) can provide the desired effect. Preferably, the spacing 70 is between about 1/8 and 1/2 inch, although smaller or larger spacing may also work.

With continuing reference to FIG. 3, cylindrical rolls 74, 76 are mounted over the shaft 66 to provide a cylindrical support surface that supports the pallets 18. The rolls 74, 76 have a hexagonal through-hole that engages the central hexagonal periphery portion of the shaft 66. The rolls 74, 76 may be separate parts or a single integrally connected part. The distal flange roll 76 includes a smaller cylindrical portion 78 and a larger flange portion 80 of a larger diameter. This configuration forms a corner 82 which receives the corresponding corner 84 of the pallet 18. In this manner, the pallets 18 are supported and carried on the small cylindrical portion 78 with the large flange portion 80 acting as a horizontal stop and engaging the side edges 86 of the pallets 18 for horizontal retention of the pallets 18. In contrast, the proximate cylindrical roll 74 includes only the small cylindrical portion 90 of equivalent diameter to the small cylindrical portion of the distal roll 76, such that the pallet 18 rides over the entire top support surface of the proximate roll 74 without a means for horizontal retention. This allows the pallets to extend horizontally beyond the first set of rollers 50 toward the pouring line 46.

Figure 4:
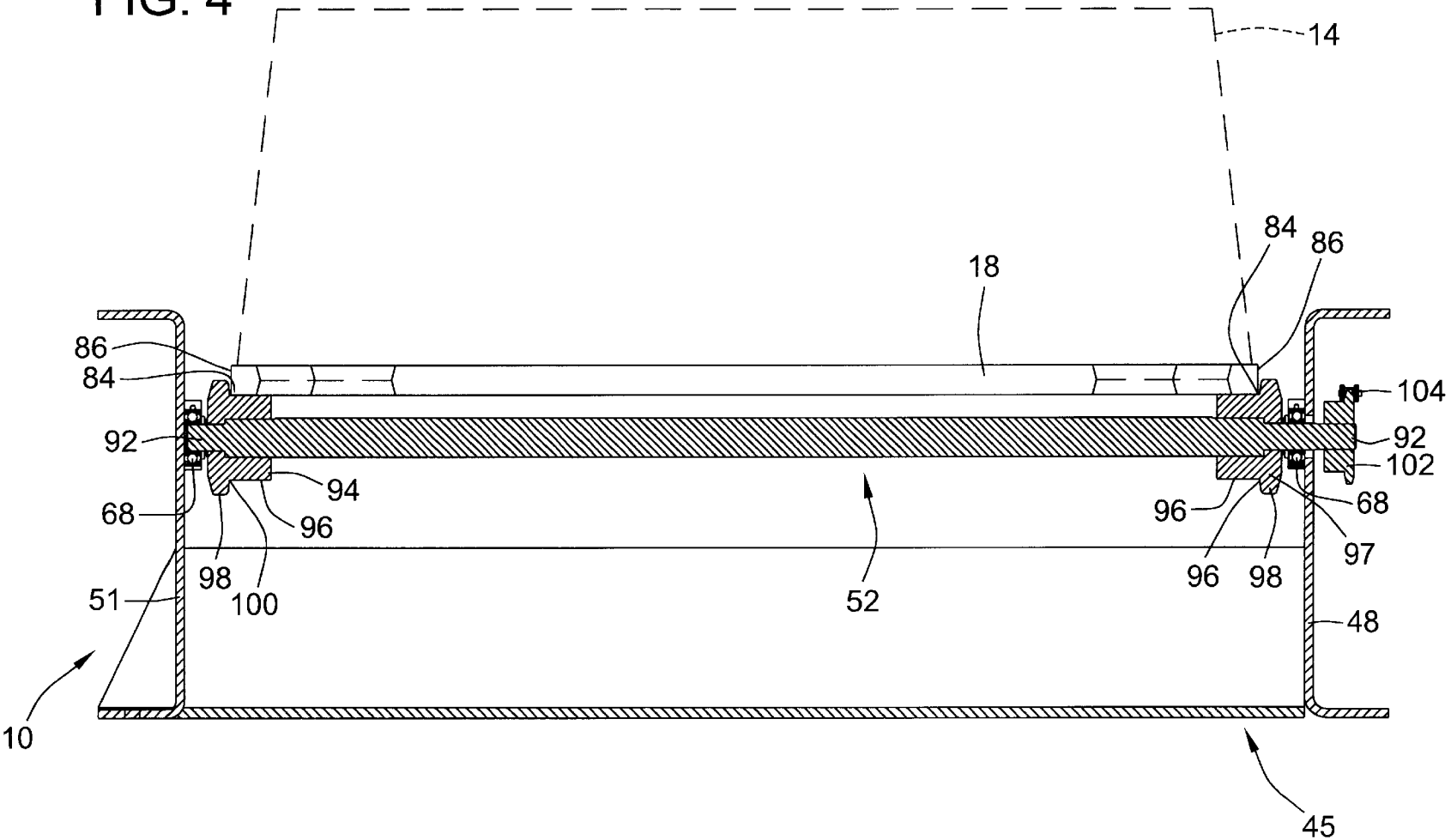
FIG. 4 is a cross section of the longer roller illustrated in FIG. 2, with a pallet and mold indicated in dashed lines.
Figure 5:
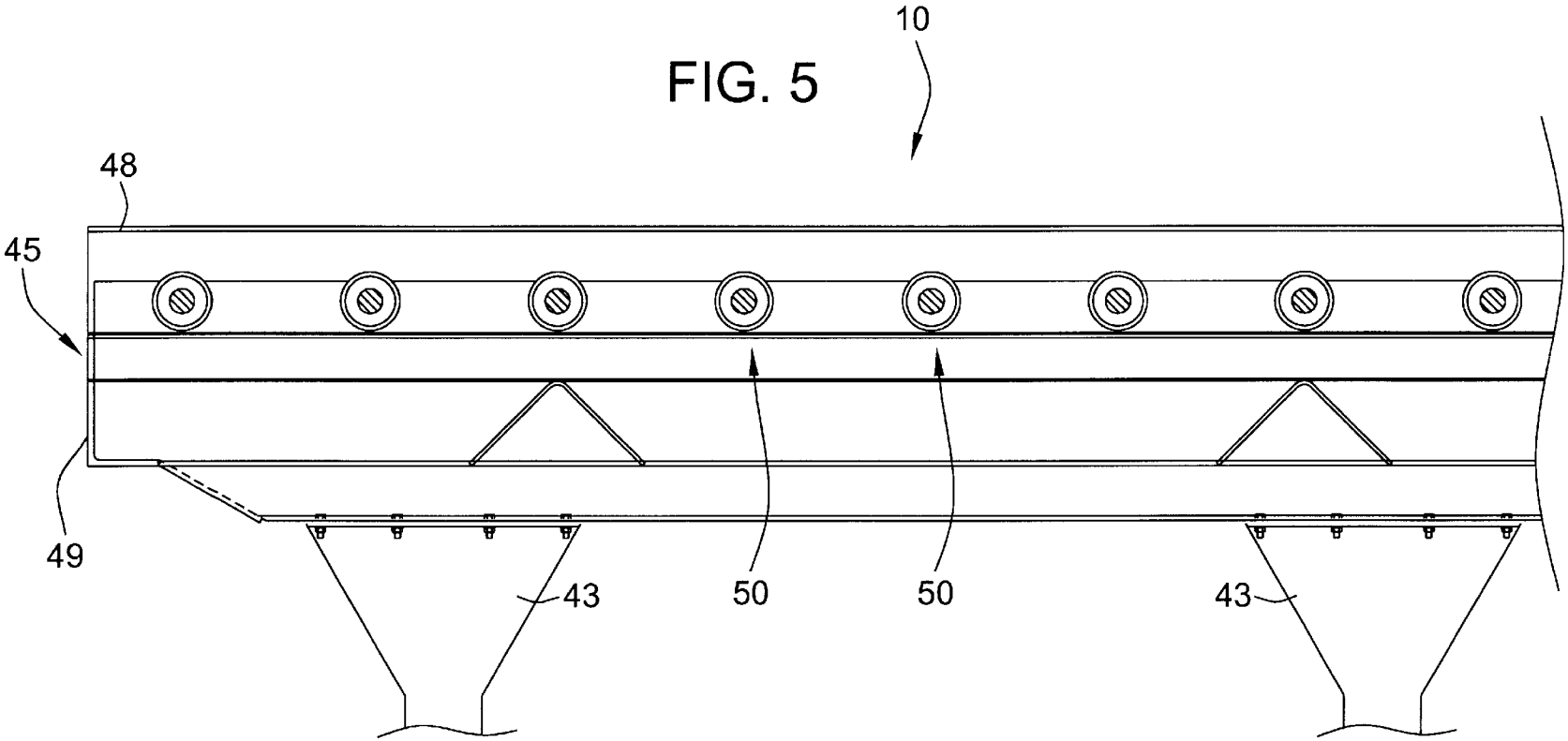
FIG. 5 is a side elevation view of the pouring side of the conveyor of the embodiment illustrated in FIG. 1.
Figure 6:
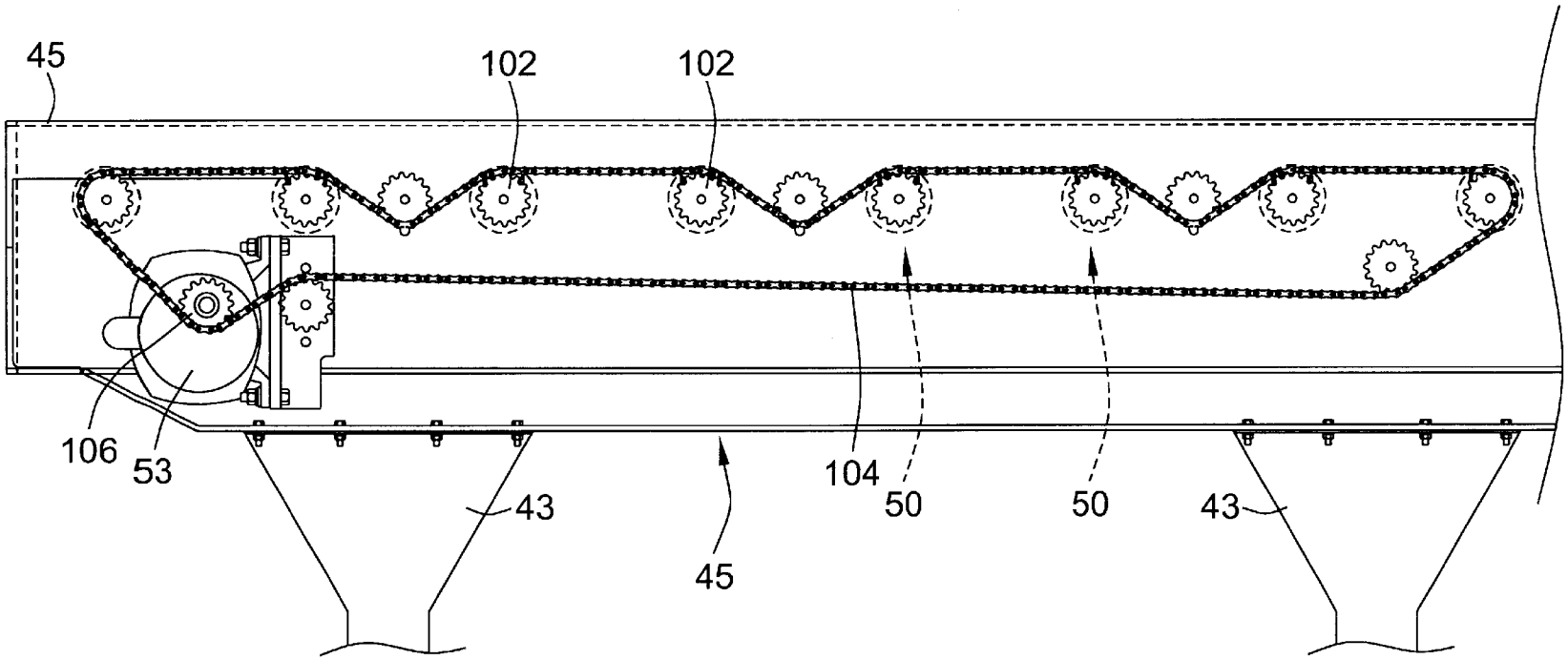
FIG. 6 is a side elevation view of the non-pouring side of the conveyor of the embodiment illustrated in FIG. 1.

Turning to FIG. 4, the structural details of one of the longer second rollers 52 are illustrated. Each second roller 52 includes a central support shaft 92 journalled in spaced apart bearings 68 that are secured to the spaced apart support beams 51, 48. In this embodiment the shaft 92 is aligned perpendicular to the path 24 and therefore the bearings 68 for the full width sections 42, 44 are diametrically opposed with centers aligned on a perpendicular axis. The rolls 94 on both the proximate and distal ends of the shaft 92 are both "flange rolls" and of the same structure as the distal flange roll 76 for the shorter first rollers 50 illustrated in FIG. 3. Each flange roll 94 includes a small cylindrical portion 96 and a flange portion 98 of a larger diameter. This configuration forms a corner 100 which receives the corresponding corner 84 of the pallet 18. In this manner, the pallets 18 are supported and carried on the small cylindrical portions 96 with the larger flange portions 98 acting as horizontal stops engaging the opposing side edges 86 of the pallets 18 retaining the pallets 18 horizontally between the spaced apart rolls 94 on the shaft 92.

The shafts 66 of the first and second sets of rollers 50 all include distal ends that project through the horizontal support beam 48 and are affixed sprockets 102 on the outside face of the distal horizontal beam 48. The sprockets 102 are driven by an endless chain 104 that is wrapped around a sprocket 106 mounted to the output shaft of the motor 53. By keeping the sprockets 102, 106 and the endless chain 104 away from the pouring line 46, molten material is less likely to damage these components. If desired, additional shields (not shown) may be mounted along the top edge of the distal horizontal beam 48 to better protect the driving components.

Figure 7:
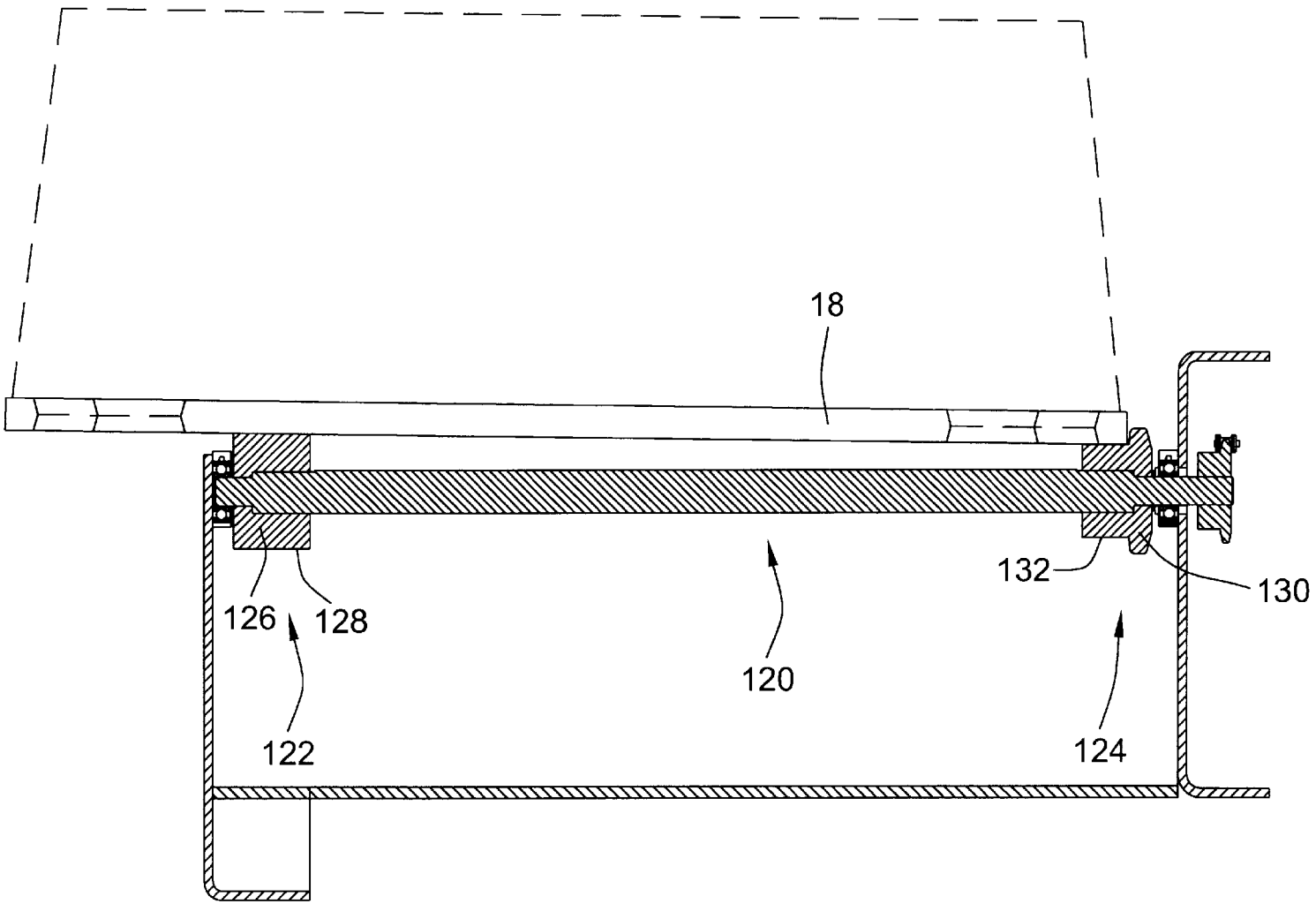
FIG. 7 is a cross section similar to FIG. 3 but according to an alternative embodiment of the present invention.

Turning to FIG. 7, an alternative embodiment of a first roller 120 is illustrated to demonstrate that other biasing means can also be used in addition to or in the alternative to that disclosed for the first embodiment. In FIG. 7, biasing is accomplished by having a greater speed imparted at the proximate end 122 as compared with the distal end 124. The cylindrical roll 126 at the proximate end has an outer cylindrical surface 128 for engaging the bottom surface of pallets 18 that is larger in diameter than the cylindrical surface 132 of the flange roll 130. Although the rolls 126, 130 rotate at the same speed, the outer cylindrical surface 128 of the cylindrical roll 126 is traveling at a greater speed due to the increased diameter. This achieves the desired bias away from the pouring line. The alternative embodiment of FIG. 7 may be accomplished without an oblique angle and perpendicular first rollers 120 in which the proximate cylindrical surface 128 is raised above the distal cylindrical surface 132. Elevation differences can also assist or provide for the biasing means. The surfaces 128, 132 may also be at about the same vertical elevation by lowering the proximate end to avoid bumps in upstream and downstream conveyor segments. Thus different diameters of the rolls 126, 130 or ends of the first rollers 120 and/or different vertical elevations of such rolls or ends of rollers 120 may also provide a biasing means for biasing the pallets away from the pouring line.

It will be appreciated that the term biasing means is meant to be a broad term covering many different types of mechanisms. Other biasing mechanisms including rotating structures separate from the first rollers could also be provided in alternate embodiments to provide for a biasing means. Other alternate embodiments may also include a helical structure in the first rollers that engages the bottom of the pallets and urges the pallets away from the pouring line. Such other biasing means may also relate to the relative size, the configuration, the orientation, the gripping materials and/or the relative distal and proximate end speeds, of the first rollers.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A molding machine, comprising:

a sand mold forming station adapted to form a plurality of sand molds, the molds being carried on pallets;

a pouting station downstream of the sand mold forming station, molten metal being poured into the sand molds at the pouring station;

a cooling station downstream of the pouring station;

a conveyor for transporting the molds on the pallets along a path through the pouring station, the pouring station arranged along a pouring side of the conveyor; and means for biasing the pallets away from the pouring side, said biasing means including a plurality of first rollers of the conveyor at the pouring station carrying the molds on the pallets, the first rollers being driven by a motor to move the pallets and molds along the path, the pallets extending horizontally beyond the first rollers toward the pouring station preventing the molten metal from being poured onto the first rollers.

2. The molding machine of claim 1 wherein the first rollers rotate about rotational axes that intersect the path at an oblique angle, the oblique angle being sufficiently large enough such that when the first rollers are driven the pallets are mobilized forwardly along the path with a bias away from the pouring line.

3. The molding machine of claim 2, wherein each first roller extends between a proximate end and a distal end, the proximate end located along the pouring side, wherein the proximate end is positioned forwardly of the distal end relative to the path.

4. The molding machine of claim 3, wherein the proximate end is located forwardly of the distal end by not less than about 1/16 of an inch, measured at respective centers along the rotational axis.

5. The molding machine of claim 1 wherein each first roller extends between a proximate end and a distal end, the proximate end located along the pouring side with the pallets projecting over the proximate end, wherein the distal end includes a small cylindrical portion and a large flange portion, the small cylindrical portion being of a smaller diameter than the large flange portion, the pallets being carried on the small cylindrical portion with the large flange portion engaging side edges of the pallets for horizontal retention of the pallets.

6. The molding machine of claim 1 wherein each first roller extends between a proximate end and a distal end, the proximate end located along the pouring side with the pallets projecting over the proximate end, wherein the proximate end supports bottom sides of pallets at a larger diameter than the distal end.

7. The molding machine of claim 6 wherein the distal end includes an enlarged flange portion engaging side edges of the pallets for horizontal retention of the pallets.

8. The molding machine of claim 1 wherein the conveyor includes an upstream segment between the pouring station and the molding machine and a downstream segment downstream of the pouring station, the downstream segments and the upstream segments having second rollers, the second rollers adapted to rotate about second rotational axes that extend perpendicular to the path, the second rollers being of a width greater than the pallets with spaced apart ends retaining the pallets therebetween.

9. The molding machine of claim 8 further comprising:

a weight and jacket installation station interposed between the sand mold forming station and the pouring station, the upstream segment extending through the weight and jacket installation station, supportive weights and jackets being installed on the sand molds at the weight and jacket installation station; and a weight and jacket removal station between the pouring station and the cooling station, the downstream segment extending through the weight and jacket removal station, the weights and jackets being removed from the sand molds at the removal station and being recycled to the weight and jacket installation station.

10. The molding machine of claim 1 wherein the conveyor comprises a support chassis comprised of pair of support beams extending horizontal and parallel, the support beams being supported at a vertical elevation by vertical support elements, the support beams including a first support beam on the pouring side and a second support beam on a non-pouring side of the conveyor, each roller including a central shaft journalled in a pair of bearing sets, one bearing set for each support beam.

11. The molding machine of claim 10 wherein the pallets extend horizontally beyond the first support beam toward the pouring station, the pallets preventing the molten metal from spilling onto the first support beam.

12. The molding machine of claim 10 wherein the shaft projects through the second support beam to a working end, the working end having a sprocket mounted thereto, the sprocket being linked to the motor with an endless chain.

13. A linear conveyor for transporting sand molds on pallets along a linear path through a pouring station of a molding machine, molten metal being poured into the sand molds at the pouring station, the pouring station being arranged on a pouring side of the linear conveyor, the pallets having a length aligned with the linear path and a width perpendicular to the linear path, the linear conveyor comprising:

a chassis;

a partial width section comprising means for biasing the pallets away from the pouring side of the conveyor, the biasing means comprising a plurality of first rollers, the first rollers including a first cylindrical support surface for supporting bottom sides of the pallets, the first cylindrical support surface extending a length less than the width of the pallets, the biasing means further comprising at least one motor supported on the chassis driving the first and second rollers for mobilizing pallets along the linear path and at least one full width section comprising a plurality of second rollers, the second rollers being wider than the first rollers, the second rollers rotating about second rotational axes, the second rotational axes extending perpendicular to the linear path.

14. The linear conveyor of claim 13 wherein the first rollers rotate about first rotational axes, the first rotational axes extending at an oblique angle to the linear path such that when the first rollers are rotated the first rollers bias the pallets carried on the first rollers away from the pouring side of the conveyor.

15. The molding machine of claim 14, wherein each first roller extends between a proximate end and a distal end, the proximate end located along the pouring side, wherein the proximate end is positioned forwardly of the distal end relative to the linear path.

16. The molding machine of claim 15, wherein the proximate end is located forwardly of the distal end by not less than about 1/16 of an inch, measured at respective centers along the rotational axis.

17. The molding machine of claim 13 wherein each first roller extends between a proximate end and a distal end, the proximate end located along the pouring side, wherein the proximate end supports bottom sides of pallets at a larger diameter than the distal end.

18. The linear conveyor of claim 13 wherein the partial width section is sandwiched between two of the full width sections to define a pouring line along the partial width section.

19. The linear conveyor of claim 13 wherein the second rollers have a second cylindrical support surface sandwiched between a pair of enlarged flange stops, the flange stops being of a larger diameter than the second cylindrical support surface and being spaced at a width not less than the width of the pallets.

20. The linear conveyor of claim 19 wherein the chassis comprises a pair of support beams extending horizontal and parallel, the support beams being supported on vertical support elements, and wherein one of the of the support beams is broken up into sections including an inset section providing a narrower spacing between support beams to define a pouring line for the pouring conveyor, wherein when one of the pallets is placed on the pouring conveyor along the pouring line, the pallet overhangs the inset section.

21. The linear conveyor of claim 13 wherein the first roller has an enlarged flange stop at the distal end, the enlarged stop having a diameter larger than the first cylindrical support surface, the enlarged stop adapted to engage a side of the pallet for horizontally retention of the pallet.

22. A pouring conveyor for a molding machine, the molding machine comprising a sand mold forming station adapted to form a plurality of sand molds, the molds being carried on pallets, a pouring station downstream of the sand mold forming station, molten metal being poured into the sand molds at the pouring station and a cooling station downstream of the pouring station, the pouring conveyor adapted to transport the molds on the pallets along a path through the pouring station with the pouring station arranged along a pouring side of the conveyor, the pouring conveyor comprising: a plurality of first rollers at the pouring station adapted to carry the molds on the pallets, the first rollers being driven by a motor for moving the pallets and molds along the path, the pallets extending horizontally beyond the first rollers over the pouring side when placed thereon for preventing the molten metal from being poured onto the first rollers wherein each first roller extends between a proximate end and a distal end, the proximate end located along the pouring side with the pallets projecting over the proximate end.

23. The molding machine of claim 22 wherein the conveyor includes an upstream segment and a downstream segment, the downstream segments and the upstream segments having second rollers, the second rollers adapted to rotate about second rotational axes that extend perpendicular to the path, the second rollers being of a width greater than the pallets with spaced apart ends adapted to retain the pallets therebetween.

24. The molding machine of claim 22 wherein the conveyor comprises a support chassis comprised of pair of support beams extending horizontal and parallel, the support beams being supported at a vertical elevation by vertical support elements, the support beams including a first support beam on the pouring side and a second support beam on a non-pouring side of the conveyor, each roller including a central shaft journalled in a pair of bearing sets, one bearing set for each support beam.

25. The molding machine of claim 24, wherein the shaft projects through the second support beam to a working end, the working end having a sprocket mounted thereto, the sprocket being linked to the motor with an endless chain.

26. The pouring conveyor of claim 22, wherein the first rollers are configured in such a way such that when the first rollers rotate, pallets conveyed on the first rollers are biased away from the pouring side.

27. The molding machine of claim 26, wherein the proximate end is located forwardly of the distal end by not less than about 1/16 of an inch, measured at respective centers along the rotational axis.

28. The molding machine of claim 27, wherein the proximate end is adapted to support bottom sides of pallets at a larger diameter than the distal end.

29. The molding machine of claim 28 wherein the distal end includes an enlarged flange portion adapted to engage side edges of the pallets for horizontal retention of the pallets.

30. The pouring conveyor of claim 27, wherein the first rollers rotate about rotational axes that intersect the path at an oblique angle, the oblique angel being sufficiently large enough such that when the first rollers are driven the pallets are mobilized forwardly along the path with a bias away from the pouring side.

31. The molding machine of claim 30, wherein each first roller extends between a proximate end and a distal end, the proximate end located along the pouring side, wherein the proximate end is positioned forwardly of the distal end relative to the path.

32. The molding machine of claim 30, wherein the distal end includes a small cylindrical portion and a large flange portion, the small cylindrical portion being of a smaller diameter than the large flange portion, the small cylindrical portion adapted to carry the pallets when placed thereon with the large flange portion engaging side edges of the pallets for horizontal retention of the pallets.

* * * * *

UNITED STATES PATENT AND TRADEMARK OFFICE

CERTIFICATE OF CORRECTION

PATENT NO. : 6,533,022 B2
DATED : March 18, 2003
INVENTOR(S) : William A. Hunter It is certified that error appears in the above-identified patent and that said Letters Patent is hereby corrected as shown below:

Column 8,
Lines 48, 53 and 57, change “molding machine” to -- linear conveyor --.

Column 9,
Lines 39 and 47, change “molding machine” to -- pouring conveyor --.

Column 10,
Lines 8, 17, 21, 24, 34 and 39, “molding machine” to -- pouring conveyor --.
Line 28, change “27” to -- 26 --.

Signed and Sealed this

Sixth Day of May, 2003

JAMES E. ROGAN
*Director of the United States Patent and Trademark Office*